US012286877B2

(12) United States Patent
Alsultan et al.

(10) Patent No.: US 12,286,877 B2
(45) Date of Patent: Apr. 29, 2025

(54) OPEN HOLE WASHOUT MAPPING AND STEERING TOOL

(71) Applicant: SAUDI ARABIAN OIL COMPANY, Dhahran (SA)

(72) Inventors: Fuad A. Alsultan, Udhailiyah (SA); Hassan M. Alabdullah, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 41 days.

(21) Appl. No.: 18/182,152

(22) Filed: Mar. 10, 2023

(65) Prior Publication Data

US 2024/0301784 A1 Sep. 12, 2024

(51) Int. Cl.

| | |
|---|---|
| ***E21B 47/002*** | (2012.01) |
| ***E21B 17/10*** | (2006.01) |
| ***E21B 23/00*** | (2006.01) |
| ***E21B 31/03*** | (2006.01) |

(Continued)

(52) U.S. Cl.

CPC ..... *E21B 47/002* (2020.05); *E21B 17/1021* (2013.01); *E21B 31/03* (2013.01); *E21B 47/022* (2013.01); *E21B 47/08* (2013.01); *E21B 23/001* (2020.05)

(58) Field of Classification Search

CPC ..... E21B 47/08; E21B 47/022; E21B 47/002; E21B 47/085

See application file for complete search history.

(56) References Cited

U.S. PATENT DOCUMENTS 2,497,990 A * 2/1950 Huber ..... E21B 47/08 33/544.3
2,719,362 A * 10/1955 Montgomery ..... E21B 47/08 33/544.3
9,249,641 B2 2/2016 Wheater et al.

(Continued)

FOREIGN PATENT DOCUMENTS

WO 1998017894 4/1998
WO 2005091888 A2 10/2005

(Continued)

OTHER PUBLICATIONS

PPC—Powered positioning caliper; retrieved from https://www.slb.com/-/media/files/fe/product-sheet/ppc-ps.

*Primary Examiner* — Robert E Fuller

(74) *Attorney, Agent, or Firm* — Vorys, Sater, Seymour and Pease LLP

(57) ABSTRACT

A well system includes a coiled tubing system arranged at a well surface and including coiled tubing extendable into a wellbore, and a washout mapping and steering tool conveyable into the wellbore as attached to the coiled tubing. The washout mapping and steering tool includes a main body having opposing first and second ends and defining a central cavity, the first end being operatively coupled to the coiled tubing and the second end being open to expose the central cavity, and one or more subcomponent tools arrangeable within the central cavity in a nested relationship. The washout mapping and steering tool is transitionable within the wellbore between a nested state, where the one or more subcomponent tools are arranged within the central cavity, and a deployed state, where the one or more subcomponent tools are extended out of the central cavity.

25 Claims, 7 Drawing Sheets

(51) Int. Cl.
*E21B 47/022* (2012.01)
*E21B 47/08* (2012.01)

(56) References Cited

U.S. PATENT DOCUMENTS

2011/0031025 A1* 2/2011 Kulkarni ..... E21B 7/064
175/61
2012/0241173 A1* 9/2012 Hales ..... E21B 47/017
166/66
2021/0396128 A1 12/2021 Wisinger, Jr.

FOREIGN PATENT DOCUMENTS

WO 2020005297 A1 1/2020
WO 2021016309 A1 1/2021

* cited by examiner

OPEN HOLE WASHOUT MAPPING AND STEERING TOOL

FIELD OF THE DISCLOSURE

The present disclosure relates generally to downhole tools and, more particularly, to a wellbore washout mapping and steering tool used to locate and map washout sections of a wellbore.

BACKGROUND OF THE DISCLOSURE

In the oil and gas industry, wellbores are oftentimes drilled and completed with open-hole sections of the wellbore. Some wellbores are drilled through and penetrate weak subterranean formations. While drilling weak formations, it is possible to inadvertently create washouts or washout sections of the wellbore. Washouts constitute enlarged regions of a wellbore, and washouts in an open-hole section is larger than the original hole size or size of the drill bit used to drill the wellbore.

Washouts are generally caused by hydraulic erosion of the wellbore wall material due to excessive bit jet velocity, but can also be caused by soft or unconsolidated formations, in-situ rock stresses, mechanical damage or abrasion caused by bottom-hole assembly (BHA) components, chemical attack and swelling or weakening of shale as it contacts fresh water, or inherently sloughing shale. Washout sections can impact well intervention jobs and can cause normal coiled tubing operations to not reach well total depth.

What is needed is full wellbore coverage using wireline tractor or coiled tubing operations to obtain reservoir data for modeling and well production optimizations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a coiled tubing system arranged at a well surface and including coiled tubing extendable into a wellbore, and a washout mapping and steering tool conveyable into the wellbore as attached to the coiled tubing. The washout mapping and steering tool may include a main body having opposing first and second ends and defining a central cavity extending at least partially between the first and second ends, the first end being operatively coupled to the coiled tubing and the second end being open to expose the central cavity, and one or more subcomponent tools arrangeable within the central cavity in a nested relationship. The washout mapping and steering tool is transitionable within the wellbore between a nested state, where the one or more subcomponent tools are arranged within the central cavity, and a deployed state, where the one or more subcomponent tools are extended out of the central cavity.

According to another embodiment consistent with the present disclosure, a method may include the steps of conveying a washout mapping and steering tool into a wellbore, the washout mapping and steering tool including a main body having opposing first and second ends and defining a central cavity extending at least partially between the first and second ends, the second end being open to expose the central cavity, and one or more subcomponent tools arrangeable within the central cavity in a nested relationship. The method may further include encountering a washout section of the wellbore, transitioning the washout mapping and steering tool from a nested state, where the one or more subcomponent tools are arranged within the central cavity, to a deployed state, where the one or more subcomponent tools are moved out of the central cavity, traversing the washout section with the washout mapping and steering tool in the deployed state, and mapping a shape and a size of the washout section with the washout mapping and steering tool as the washout mapping and steering tool traverses the washout section.

According to another embodiment consistent with the present disclosure, a washout mapping and steering tool is disclosed and may include a main body having opposing first and second ends and defining a central cavity extending at least partially between the first and second ends, the second end being open to expose the central cavity, a gyro tool receivable within the central cavity, an azimuth tool receivable within an inner cavity of the gyro tool, and a lower joint tool receivable within an inner cavity of the azimuth tool. The washout mapping and steering tool is transitionable within a wellbore between a nested state, where the gyro tool, the azimuth tool, and the lower joint tool are all arranged within the central cavity in a mutually-nested configuration, and a deployed state, where the gyro tool exits the central cavity, the azimuth tool exits the inner cavity of the gyro tool, and the lower joint tool exits the inner cavity of the azimuth tool.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
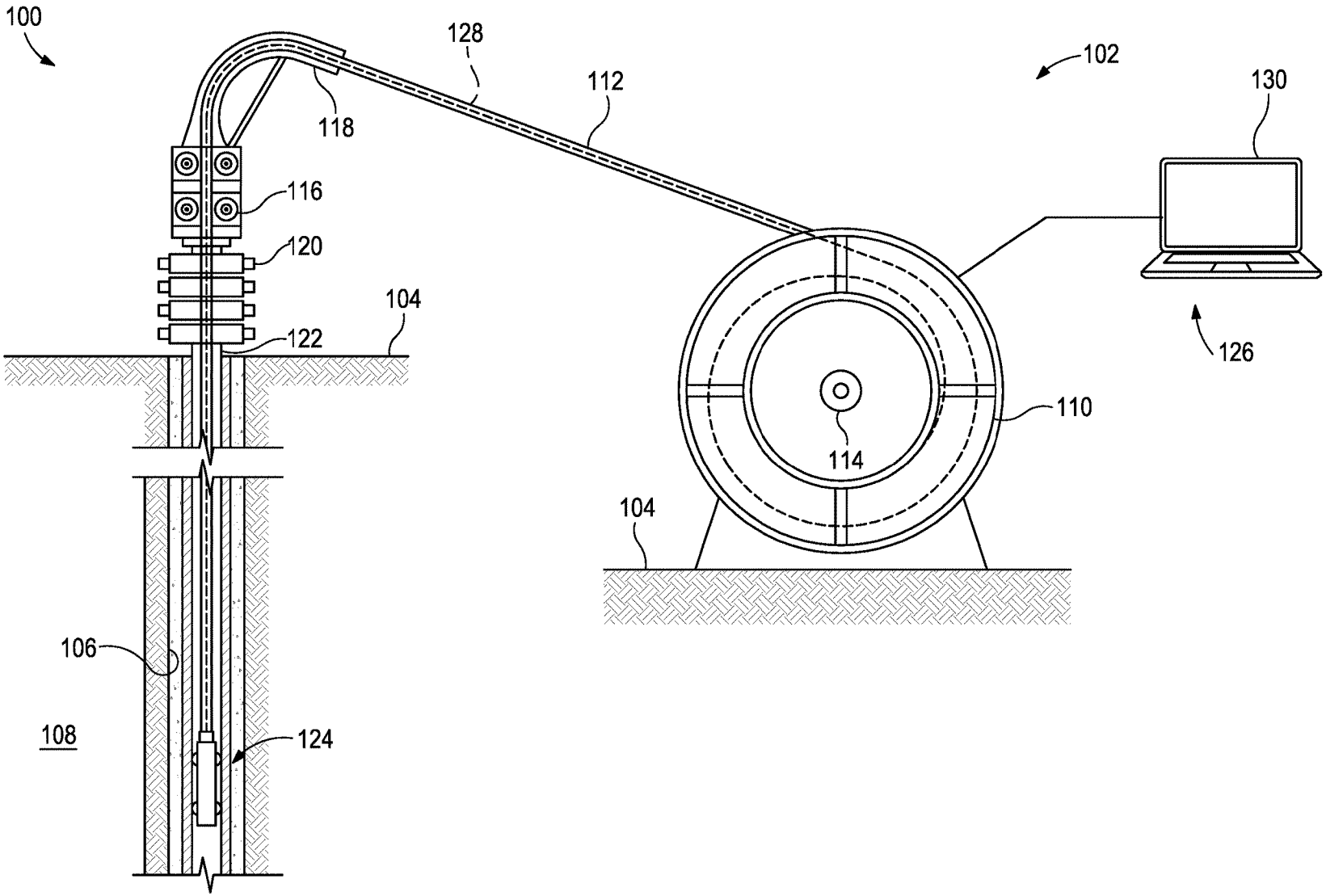
FIG. 1 is a schematic diagram of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to downhole tools used in the oil and gas industry and, more particularly, to a wellbore washout mapping and steering tool used to locate and map washout sections of a drilled wellbore. This washout mapping and steering tool described herein may prove advantageous in providing a means to understand and visualize the shape of washout sections within open hole completion portions of a wellbore. The washout mapping and steering tool may have the capability to maneuver through the washout sections and subsequently re-enter the main wellbore following the washout section, and can continue to run-in-hole until it reaches the well total depth for full wellbore coverage.

FIG. 1 is a schematic diagram of an example well system 100 that may incorporate the principles of the present disclosure. As illustrated, the well system 100 includes a coiled tubing system 102 arranged at a well surface 104 (e.g., the Earth's surface). A wellbore 106 extends from the well surface 104 and may penetrate one or more subterranean formations 108. While the well system 100 is depicted as a land-based operation, the well system 100 may alternatively be situated in an offshore setting, such as an offshore drilling or completion rig, without departing from the scope of the disclosure.

The coiled tubing system 102 includes a spool or "reel" 110, which serves as a storage apparatus for coiled tubing 112, alternately referred to as "coil" tubing. The coiled tubing 112 comprises a continuous length of flexible pipe capable of being wound onto and unwound from the reel 110. In some applications, as illustrated, the reel 110 may be arranged directly on the well surface 104, but could alternatively be mounted to a transport vehicle (e.g., a truck), a production rig (e.g., such as an offshore platform or the like), or may otherwise be skid-mounted. Rotation of the reel 110 may be controlled by a direct drive prime mover 114 mounted on the reel 110, such as a hydraulic motor or a chain-and-sprocket drive assembly.

The coiled tubing 112 is guided from the reel 110 to an injector assembly 116 via a tubing guide arch 118, alternately referred to as a "gooseneck." The tubing guide arch 118 supports the coiled tubing 112 through a bending radius and guides the coiled tubing 112 into the injector assembly 116, alternately referred to as an "injector head". The injector assembly 116 is designed to grip the outer diameter of the coiled tubing 112 and provide the force required to convey the coiled tubing 112 into the wellbore 106 and subsequently retrieve the coiled tubing 112. The injector assembly 116 is designed to support the full weight of the coiled tubing 112, and allows an operator to control the rate of lowering the coiled tubing 112 into the well.

The coiled tubing system 102 may further include a well control stack 120 operatively coupled to the injector assembly 116 and interposing the injector assembly 116 and a wellhead 122. The wellhead 122 constitutes the surface termination of the wellbore 106, and the wellbore 106 extends therefrom. The well control stack 120 can include a stripper assembly that provides the necessary pressure control and lubrication for the coiled tubing 112 as the coiled tubing 112 is conveyed into or retrieved from the wellbore 106. The well control stack 120 can also include a blowout preventer or "BOP", which includes a plurality of hydraulically-operated rams used to mechanically seal off the wellbore 106 at the well surface 104 if well control is lost.

One or more downhole tools may be operatively coupled to the distal end of the coiled tubing 112. According to embodiments of the present disclosure, a washout mapping and steering tool 124 may be coupled to the coiled tubing 112 and configured to locate and map washout sections or zones of the drilled wellbore 106. As described in greater detail below, the washout mapping and steering tool 124 may be operable to navigate through and bypass open-hole washout sections in long-reach horizontal wells, and may be used to map out and characterize the shape and size of the open-hole washout sections. The washout mapping and steering tool 124 may also be capable of accessing the remaining downhole portions of the wellbore 106 for well logging purposes or well treatment operations. Washout sections often limit well intervention possibilities due to tool orientation, but the washout mapping and steering tool 124 provides a means of accessing long-reach horizontal wells that include washout sections.

The well system 100 may also include a control system 126 in communication with the coiled tubing system 102 and the washout mapping and steering tool 124. The control system 126 may be configured to control operation of both the coiled tubing system 102 and the washout mapping and steering tool 124. An operator may be able to control operation of all facets of the coiled tubing system 102 and the washout mapping and steering tool 124 from the control system 126. The control system 126 may be positioned on a transport vehicle along with the reel 110, but could alternatively comprise a skid-mounted component. The control system 126, for example, may be arranged within a control cabin mounted to the bed of a truck.

In some embodiments, the control system 126 may be in communication with the washout mapping and steering tool 124 via a signal cable 128 that extends along the coiled tubing 112. In some embodiments, the signal cable 128 may be secured to the exterior of the coiled tubing 112, but could alternatively be arranged within the coiled tubing 112 (or a combination of both). The signal cable 128 may facilitate real-time communication of data and signals to and from the washout mapping and steering tool 124, and may also provide electrical power to the washout mapping and steering tool 124. In other embodiments, however, the signal cable 128 may be omitted, and the washout mapping and steering tool 124 may be able to communicate in real-time with the control system 126 via any known wireless telemetry modalities, without departing from the scope of the disclosure. In such embodiments, the washout mapping and steering tool 124 may include an onboard power source, such as one or more batteries, a fuel-cell, a generator, etc.

As illustrated, the control system 126 may include a computer or computer unit 130 having a display or graphical user interface that allows an operator to manage operation of the coiled tubing system 102 and the washout mapping and steering tool 124. The computer 130 may also display data and information obtained from the washout mapping and steering tool 124 during operation. The computer 130 may have a processor and a computer readable medium on which programmable instructions may be stored. The computer readable medium can include a nonvolatile or non-transitory memory with data and instructions that are accessible to the processor and executable thereby. The computer readable medium may also be pre-programmed or selectively programmable with instructions for operating the washout mapping and steering tool 124 or any of the method steps described herein.

Figure 2A:
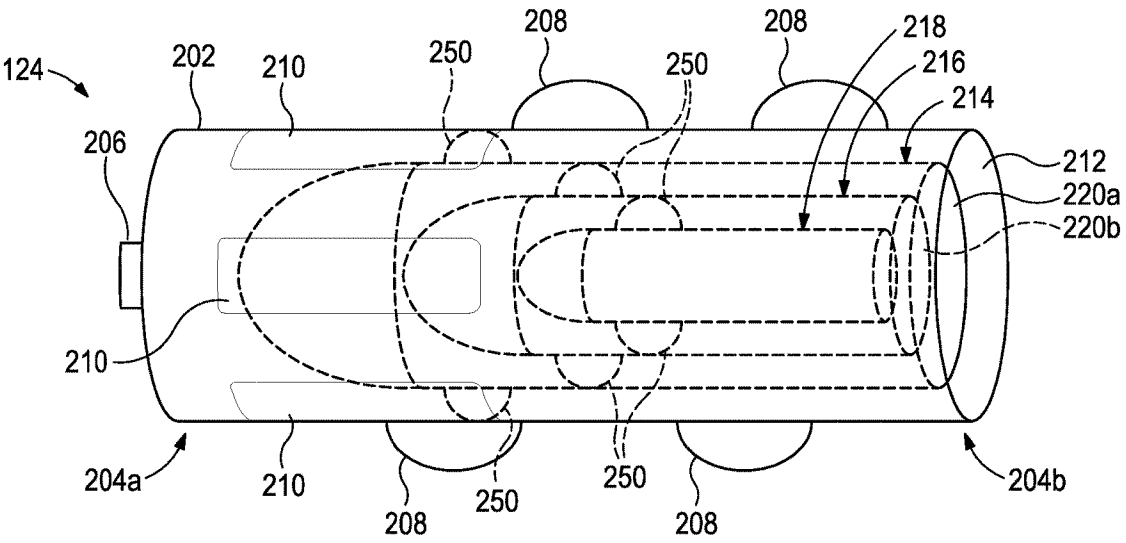
FIGS. 2A and 2B are schematic side views of the washout mapping and steering tool of FIG. 1, according to one or more embodiments of the present disclosure.
Figure 2B:
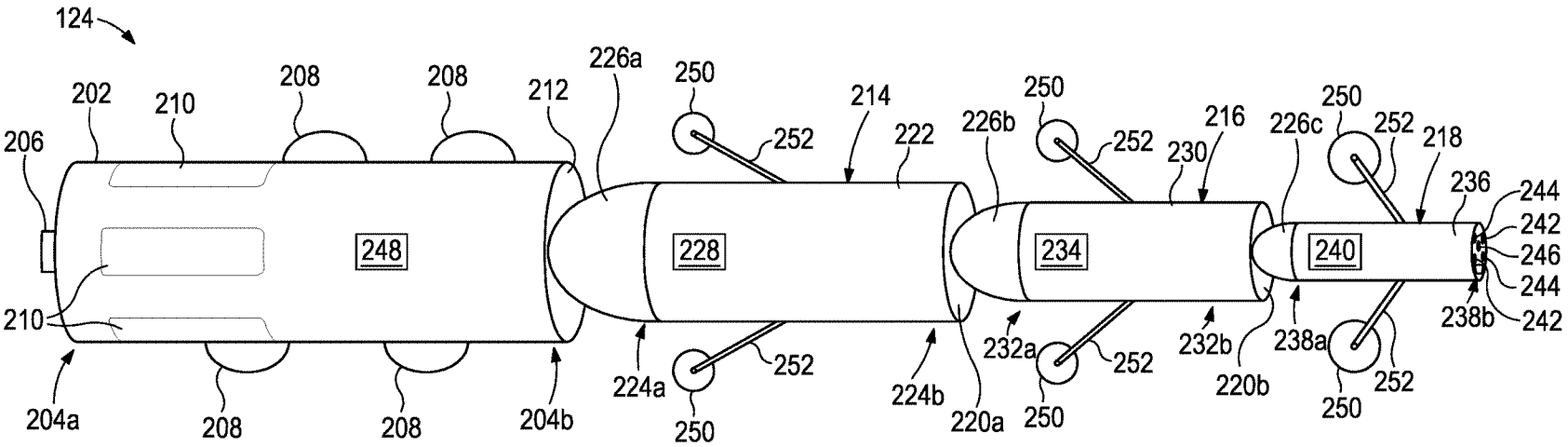

FIGS. 2A and 2B are schematic side views of the washout mapping and steering tool 124, according to one or more embodiments of the present disclosure. More specifically, FIG. 2A depicts the washout mapping and steering tool 124 (hereafter "the tool 124") in a first or "nested" state, and FIG. 2B depicts the tool 124 in a second or "deployed" state. As illustrated, the tool 124 includes an elongate main body 202 having opposing first and second ends 204*a* and 204*b*. The main body 202 may comprise a generally cylindrical structure, and the second end 204*a* may be open and otherwise open-ended to accommodate therein various subcomponent parts of the tool 124, as described below.

A connector 206 may be provided at the first end 204*a*, and may be configured to operatively, fluidly, and communicably couple the tool 124 to the distal end of the coiled tubing 112 (FIG. 1). As operatively coupled to the tool 124, the coiled tubing 112 may be able to convey the tool 124 downhole within the wellbore 106 (FIG. 1). As fluidly coupled to the tool 124, the coiled tubing 112 may be configured to convey various fluids to the tool 124 four various purposes. In such embodiments, a hydraulic fluid may be conveyed to the tool 124 and used to operate or actuate various hydraulically actuatable portions of the tool 124. Moreover, in such embodiments, other fluids, such as completion fluids or the like, may also be provided to the tool 124 to undertake various downhole treatment operations. As communicably coupled to the tool 124, the coiled tubing 112 may also facilitate signal and power communication to the tool 124, such as via the signal cable 128 (FIG. 1). Electrical power and command signals may be conveyed from the control system 126 (FIG. 1) to the tool 124, and data and information obtained by the tool 124 may be conveyed back to the control system 126 via the signal cable 128. As mentioned above, however, the signal cable 128 may be omitted and the tool 124 may alternatively communicate with the control system 128 via any known wireless telemetry modality.

A plurality of wheels 208 (four shown) may be rotatably mounted to the main body 202 and may be configured to extend radially outward and past the outer diameter of the main body 202. The wheels 208 help the tool 124 traverse the wellbore 106 (FIG. 1), including any open-hole washout zones or sections of the wellbore 106 that may be encountered. As the tool 124 traverses the wellbore 106, the wheels 208 may rollingly engage the inner walls of the wellbore 106, which eases movement of the tool 124 through the wellbore 106. In some embodiments, the wheels 208 may comprise passive mechanical components that merely provide rotational or rolling contact with the inner walls of the wellbore 106. In other embodiments, however, the wheels 208 may be powered and otherwise mechanically driven to advance the tool 124 within the wellbore 106, in either the uphole or downhole directions. In such embodiments, the tool 124 may include one or more motors operatively coupled to the wheels 208 and configured to provide the motive force to rotate (drive) the wheels 208. Accordingly, in at least one embodiment, the tool 124 may operate similar to a downhole tractor, which may prove advantageous in highly-deviated sections of the wellbore 106 where the coiled tubing 112 may be unable to push the tool 124 downhole.

In at least one embodiment, the wheels 208 may be radially expandable (extendible) away from the main body 202. In such embodiments, the wheels 208 may be operatively coupled to radially extendible arms or the like, that may be deployed and otherwise actuated when the tool 124 encounters a washout section of the wellbore 106 (FIG. 1). Once the tool 124 encounters a washout zone, the extendible arms will extend radially outward and thereby move the wheels 208 into contact (or closer into contact) with adjacent wellbore surfaces, thereby aiding the tool 124 in further movement within the wellbore 106. The arms may be hydraulically actuatable, and also capable of retracting back to the stowed position.

In some embodiments, the tool 124 may include a plurality of expandable pads 210 arranged about the outer circumference of the main body 202. The expandable pads 210 may be actuatable and otherwise operable to help change the general trajectory of the tool 124 as it traverses the wellbore 106 (FIG. 1). More specifically, each expandable pad 210 may be selectively actuatable to extend radially outward and thereby engage an adjacent inner wall of the wellbore 106, and thereby adjust the general position or orientation of the tool 124 within the wellbore 106. The general trajectory of the tool 124 may be adjusted by selectively actuating one of the expandable pads 210 located in the opposite direction. Moreover, the degree of turning into a specific direction can also be controlled through the expansion ratio of the expandable pads 210. Furthermore, the expandable pads 210 may also be used to help map washout zones or sections of the wellbore 106, and to alter the trajectory of the tool 124 post mapping.

The expandable pads 210 may be made of a variety of rigid and generally erosion resistant materials. Example materials for the expandable pads 210 include, but are not limited to, a metal, a metal alloy, a polymer, a composite material, an elastomer, or any combination thereof. The expandable pads 210 may be arranged about the entire outer circumference of the main body 202, and may be equidistantly or non-equidistantly spaced from each other. In some embodiments, the expandable pads 210 may be hydraulically actuatable, but could alternatively be mechanically actuatable, or a combination of both.

The tool 124 may further include one or more subcomponent tools configured to be arranged within the main body 202 in a nested relationship. More particularly, the main body 202 may provide and otherwise define a central cavity 212, and the open-ended second end 204*b* of the main body 202 may provide access to the central cavity 212. When the tool 124 is in the nested state, as shown in FIG. 2A, the subcomponent tools are arranged within the central cavity 212 in a nested configuration. In contrast, when the tool 124 is transitioned to the deployed state, as shown in FIG. 2B, the subcomponent tools are moved out of the central cavity 212. It is contemplated herein to have the subcomponent tools in a state between the nested and deployed states. In such embodiments, at least one of the subcomponent tools, but not all, may be transitioned out of the central cavity 212.

In the illustrated embodiment, the tool 124 includes three subcomponent tools, namely, a gyro tool 214, an azimuth tool 216, and a lower joint tool 218, which are shown in FIG. 2A in dashed lines. The subcomponent tools 214-218 may be designed and otherwise configured to be received within the central cavity 212 in a mutually-nested relationship. More specifically, the gyro tool 214 may be sized and otherwise configured to be received within the central cavity 212, the azimuth tool 216 may be sized and otherwise configured to be received within an inner cavity 220*a* of the gyro tool 214, and the lower joint tool 218 may be sized and otherwise configured to be received within an inner cavity 220*b* of the azimuth tool 216. While three subcomponent tools are shown, it will be appreciated that more or less than three may be included in the tool 124, without departing from the scope of the disclosure.

As best seen in FIG. 2B, the gyro tool 214 includes an elongate, cylindrical body 222 having opposing first and second ends 224*a* and 224*b* and defining the inner cavity 220*a*. The second end 224*b* may be open-ended, which allows the azimuth tool 216 to enter the inner cavity 220*a* in a nested relationship. The first end 224*a* may include or provide a pivotable coupling 226*a* operable to pivotably attach the gyro tool 214 to the main body 202. When the body 222 of the gyro tool 214 transitions out of the central cavity 212, the pivotable coupling 226*a* will remain attached to the main body 202 and allow the gyro tool 214 to pivot about multiple axes of rotation relative to the main body 202. In some embodiments, the pivotable coupling 226*a* may comprise a type of universal or articulable joint, but could alternatively comprise other types of pivotable attachments that allow the gyro tool 214 to pivot relative to the main body 202, a joint between two parts that allows radial movement of one part relative to the other.

The gyro tool 214 may be configured to provide high accuracy space coordination to support mapping of the wellbore 106 (FIG. 1) and any washout sections that may be present within the wellbore 106. In particular, the gyro tool 214 may be used to determine the shape and size of washout zones or sections that may be formed in the wellbore 106. Measurements and data obtained by the gyro tool 214 will show exact coordinate locations of the tool 124 in terms of x-, y-, and z-direction with the position of the wellhead 122 (FIG. 1) as a reference point.

To accomplish this, the gyro tool 214 may include a gyroscope unit 228 housed within or otherwise attached to the body 222. More specifically, the gyroscope unit 228 may be fixedly coupled to the body 222 so that there is a known relationship between the location of the gyroscope unit 228 and the geometry of the body 222. The gyroscope unit 228 may be a three-axis gyroscope to provide measurements of angular velocity about the x-, y-, and z-axes of the gyroscope unit 228. The x-, y-, and z-axes of the gyroscope unit 228 may (or may not) correspond with the x-, y-, and z-axes of the body 222. In some embodiments, measurements obtained by the gyroscope unit 228 during operation may be transmitted to the control system 126 (FIG. 1) in real-time for processing. Alternatively, or in addition thereto, measurements obtained by the gyroscope unit 228 may be stored in a conventional downhole recorder (not shown), which can be accessed at the well surface 104 when the tool 124 is retrieved. The gyroscope measurements obtained by the gyroscope unit 228 may be processed by the control system 126 to determine various measurements of the wellbore 106 including, but not limited to, borehole diameter, borehole shape, washout diameter, washout shape, and any combination thereof. The measurement obtained by the gyroscope unit 228 will be integrated with other measurements and support in creating a better mapping of the wellbore 106, including any washout zones.

As best seen in FIG. 2B, the azimuth tool 216 includes an elongate, cylindrical body 230 having opposing first and second ends 232*a* and 232*b* and defining the inner cavity 220*b*. The second end 232*b* may be open-ended, which allows the lower joint tool 218 to enter the inner cavity 220*b* in a nested relationship. The first end 232*a* may include or provide a pivotable coupling 226*b* operable to pivotably attach the azimuth tool 216 to the gyro tool 214. The pivotable coupling 226*b* may be similar to the pivotable coupling 226*a*, and therefore will not be described again. When the body 230 of the azimuth tool 216 transitions out of the inner cavity 220*a* of the gyro tool 214, the pivotable coupling 226*b* may remain attached to the gyro tool 214 and allow the azimuth tool 216 to pivot about multiple axes of rotation relative to the gyro tool 214.

The azimuth tool 216 may be configured to identify the exact orientation of the tool 124 relative to true north, and thereby help map the general shape of the wellbore 106 (FIG. 1), including any washout zones or sections present in the wellbore 106. As will be appreciated, mapping the shape of washout zones or sections with respect to a known orientation will help identify the location and the entry point of the remaining downhole portions of the wellbore 106. This may also help the tool 124 navigate through the washout sections. To accomplish this, the azimuth tool 216 may include one or more sensors 234 configured to determine borehole characteristics including, but not limited to, inclination, azimuth, position in space, magnetic tool face, and magnetic azimuth (i.e., an azimuth value determined from magnetic field measurements). In some embodiments, these data can be used to identify the formation rock type and its characteristics. In some embodiments, measurements obtained by the sensors 234 during operation may be transmitted to the control system 126 (FIG. 1) in real-time for processing. Alternatively, or in addition thereto, measurements obtained by the sensors 234 may be stored in a conventional downhole recorder (not shown), which can be accessed at the well surface 104 when the tool 124 is retrieved. In some embodiments, the sensors 234 may include one or more sonic or ultrasonic sensors configured to obtain data that can support in determining the shape of the wellbore 106, including any washout sections present therein.

As best seen in FIG. 2B, the lower joint tool 218 includes an elongate, cylindrical body 236 having opposing first and second ends 238*a* and 238*b*. The lower joint tool 218 constitutes the distal or downhole end of the tool 124, and also constitutes the smallest subcomponent part of the tool 124 sized to be received within the inner cavity 220*b* of the azimuth tool 216. The first end 238*a* may include or provide a pivotable coupling 226*c* operable to pivotably attach the lower joint tool 218 to the azimuth tool 216. The pivotable coupling 226*c* may be similar to the pivotable couplings 226*a,b*, and therefore will not be described again. When the body 236 of the lower joint tool 218 transitions out of the inner cavity 220*b* of the azimuth tool 216, the pivotable coupling 226*c* may remain attached to the azimuth tool 216 and allow the lower joint tool 218 to pivot about multiple axes of rotation relative to the azimuth tool 216.

The lower joint tool 218 may include and otherwise provide a tension-compression sensor 240, also referred to as an axial stress sensor, configured to continuously monitor for downhole obstructions within the wellbore 106 (FIG. 1). In some embodiments, when an obstruction within the wellbore 106 is identified by the tension-compression sensor 240, a signal may be transmitted to the control system 126 (FIG. 1) in real-time for processing via the signal cable 128 (FIG. 1) or various wireless telemetry modalities. In such embodiments, the control system 126 may direct the tool 124 to change its trajectory within the wellbore 106 to avoid and otherwise traverse the identified obstruction. In example operation, multiple measurements with different tool orientations may be recorded with the support of the tension-compression sensor 240. As a result, a path to traverse the identified obstruction can be determined and the remaining portions of the wellbore 106 can be accessed.

In some embodiments, the lower joint tool 218 may include one or more cameras 242 (two shown) and one or more lights 244 (two shown) arranged and otherwise provided at the second end 238*b*. The cameras 242 may provide real-time visual feedback and images of the interior of the wellbore 106 (FIG. 1) as the tool 124 traverses the wellbore 106. The visual feedback may be transmitted in real-time to the control system 126 (FIG. 1) for consideration or processing. The lights 244 may illuminate the interior the wellbore 106 thereby allowing the cameras 242 to provide clear visual feedback.

In some embodiments, the lower joint tool 218 may further include one or more nozzles 246 provided at the second and 238*b*. The nozzles 246 may be configured to eject or discharge various fluids into the wellbore 106 (FIG. 1) to help clear obstructions within the wellbore 106. The discharge fluid may comprise, for example, a clear fluid such as water (e.g., brine, fresh, etc.). Clearing obstructions within the wellbore 106 with fluids discharged from the nozzle(s) 246 may help the tool 124 extend deeper into the wellbore 106.

In some embodiments, the tool 124 may include an actuation mechanism or assembly 248 operable to transition the tool 124 from the nested state, as shown in FIG. 2A, to the deployed state, as shown in FIG. 2B. When it is desired to transition the tool 124 to the deployed state, a signal may be sent from the control system 126 (FIG. 1) to trigger operation of the actuation assembly 248. In some embodiments, activation of the actuation assembly 248 may be triggered when it is determined that the tool 124 cannot progress further downhole within the wellbore 106. This may occur when the tool 124 encounters a downhole obstruction or a washout section of the wellbore 106 (FIG. 1). In such moments, the tool 124 will be actuated and mapping of the downhole obstruction or the washout section can commence. The tool 124 may then be used to access the remaining downhole portions of the wellbore 106.

The actuation assembly 248 may comprise any device, system, or configuration capable of extending the subcomponent tools 214-218 out of the inner cavity 212 of the main body 202. In some embodiments, the actuation assembly 248 may be hydraulically actuatable, but could alternatively be mechanically actuatable, such as through geared interfaces or the like, or a combination of both. The actuation assembly 248 may also be operable or otherwise actuatable to return the tool 124 to the nested state.

In some embodiments, one or the subcomponent tools 214-218 may include one or more wheels 250 configured to extend radially outward upon moving to the deployed state. In the illustrated embodiment, each subcomponent tool 214-218 includes the wheels 250, but in other embodiments less than all of the subcomponent tools 214-218 may include wheels 250.

In some embodiments, each wheel 250 may be operatively and rotatably mounted to a corresponding radially extendable arm 252 (FIG. 2B) operable to transition the wheels 250 between a first or "stowed" configuration, as shown in FIG. 2A (wheels 250 shown in dashed lines), and a second or "extended" configuration, as shown in FIG. 2B. When the wheels 250 are in the stowed configuration, the subcomponent tools 214-218 may be able to be nested within the host subcomponent tool 214, 216, or within the main body 202. When in the stowed configuration, the wheels 250 may be at least partially embedded within the body 222, 230, 236 of the corresponding subcomponent tool 214-218, which allows the subcomponent tools 214-218 to be fully assembled in the nested state. More specifically, when the wheels 250 of the lower joint tool 218 are in the stowed configuration, the lower joint tool 218 may be sized to be accommodated within the inner cavity 220*b* of the azimuth tool 216. Similarly, when the wheels 250 of the azimuth tool 216 are in the stowed configuration, the azimuth tool 216 may be sized to be accommodated within the inner cavity 220*a* of the gyro tool 218. Lastly, when the wheels 250 of the gyro tool 218 are in the stowed configuration, the gyro tool 218 may be sized to be accommodated within the central cavity 212 of the main body 202.

Upon transitioning the tool 124 to the deployed state, the arms 252 may extend radially outward and thereby correspondingly move the wheels 250 radially outward. In some embodiments, the arms 252 may be spring-loaded and otherwise naturally biased radially outward. In such embodiments, once the subcomponent tools 214-218 exit the host subcomponent tool 214, 216 or the main body 202, the arms 252 may automatically and naturally extend radially outward, thereby moving the wheels 250 in the same direction. In other embodiments, however, the arms 252 may be selectively actuatable, which allows the wheels 250 to be actuated between the stowed and retracted configurations. In such embodiments, the arms 252 may be operatively coupled to and otherwise powered by one or more actuation devices or mechanisms configured to mechanically or hydraulically extend the arms 252 radially outward or radially inward on-demand. In such embodiments, actuation of the arms 252 may be dictated and otherwise controlled by the control system 126 (FIG. 1).

In some embodiments, one or more of the wheels 250 may comprise passive mechanical components that merely provide rotational or rolling contact with the inner walls of the wellbore 106 (FIG. 1) when moved to the extended configuration. In other embodiments, however, the wheels 250 may be powered and otherwise mechanically driven to advance the tool 124 within the wellbore 106, in either the downhole or uphole directions. In such embodiments, the tool 124 may include one or more motors (not shown) operatively coupled to the wheels 250 and configured to provide the motive force to rotate (drive) the wheels 250.

Figure 3A:
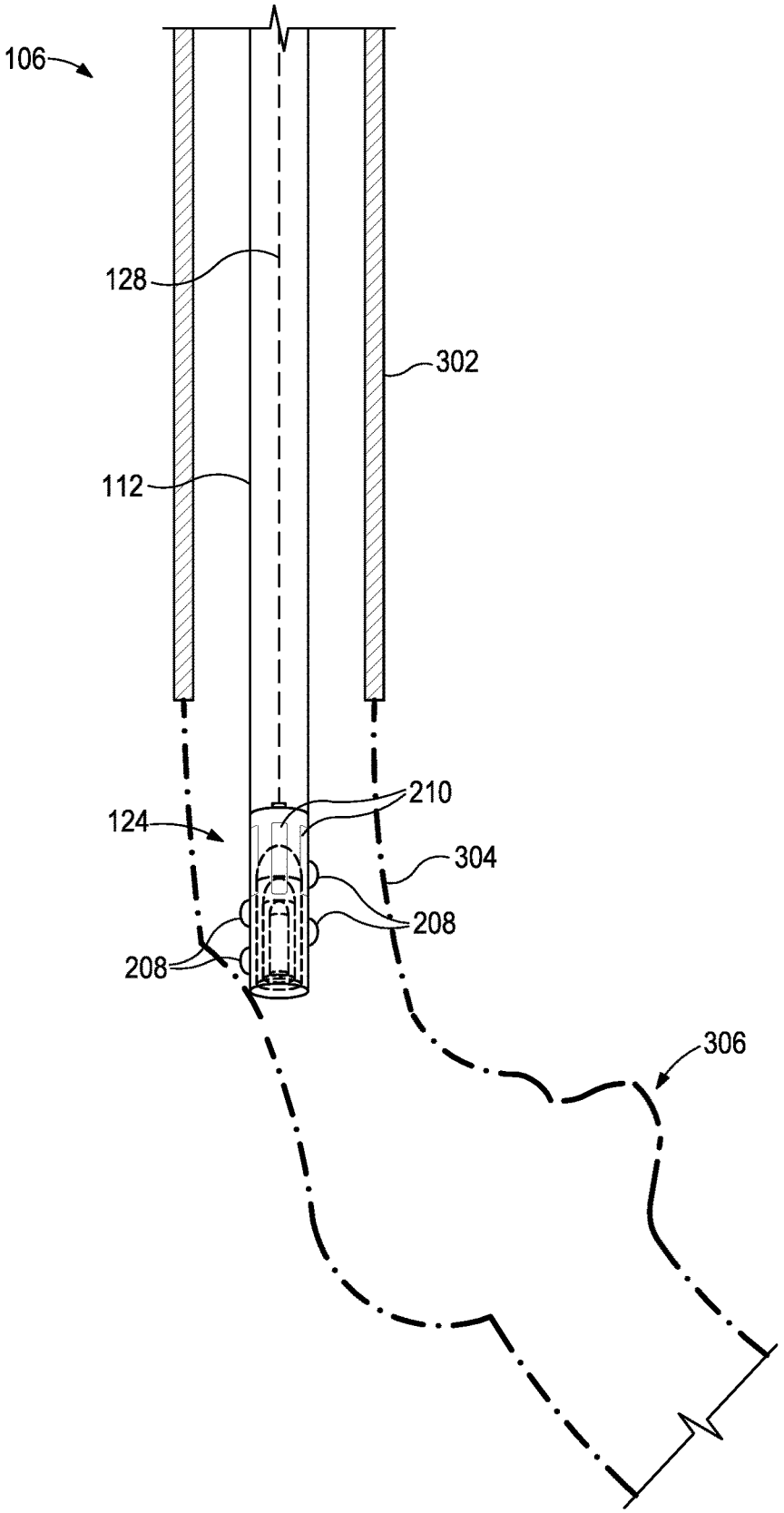
FIGS. 3A-3C are enlarged schematic views of a portion of the wellbore of FIG. 1 showing progressive operation of the washout mapping and steering tool of FIGS. 2A-2B, according to one or more embodiments.
Figure 3B:
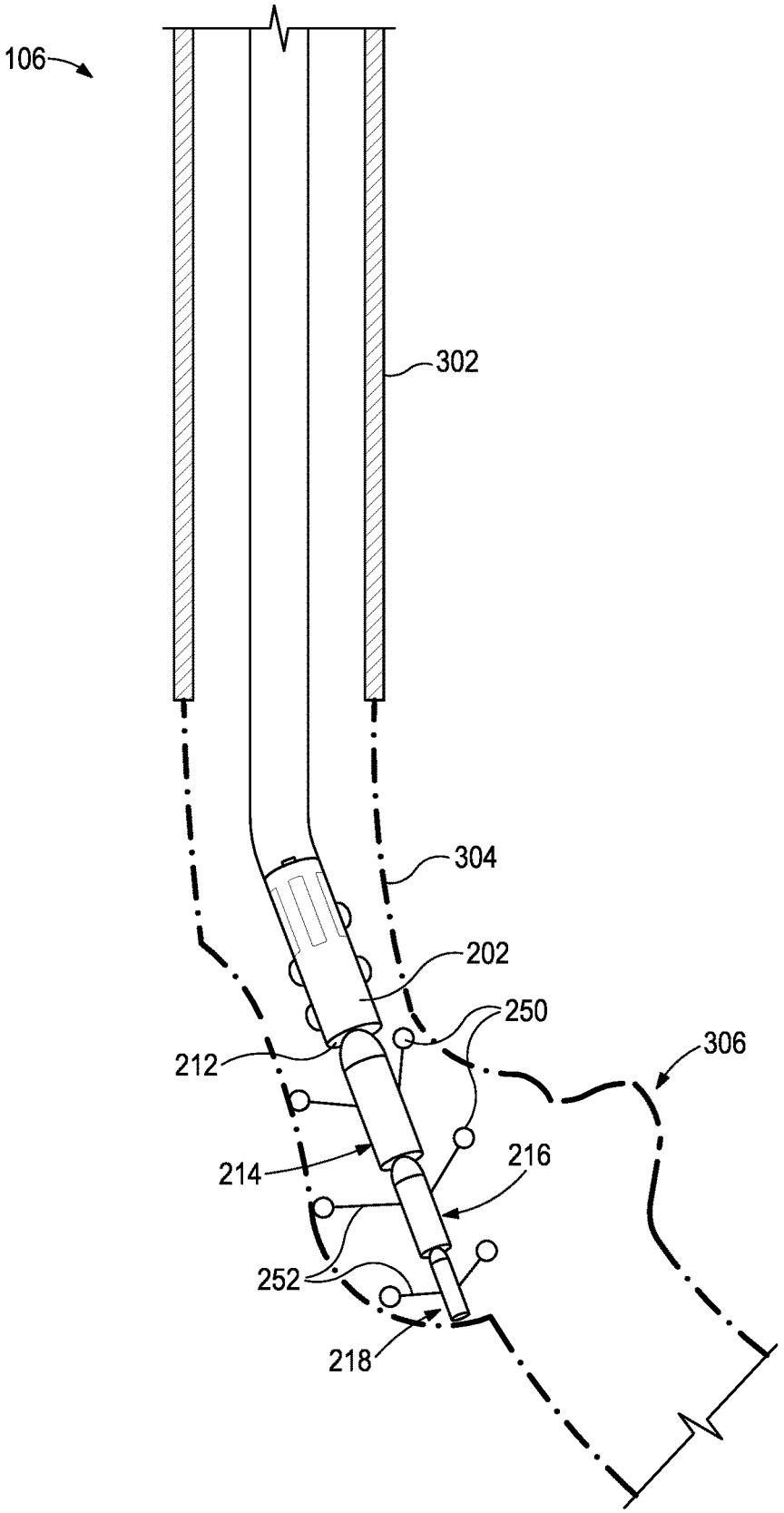
Figure 3C:
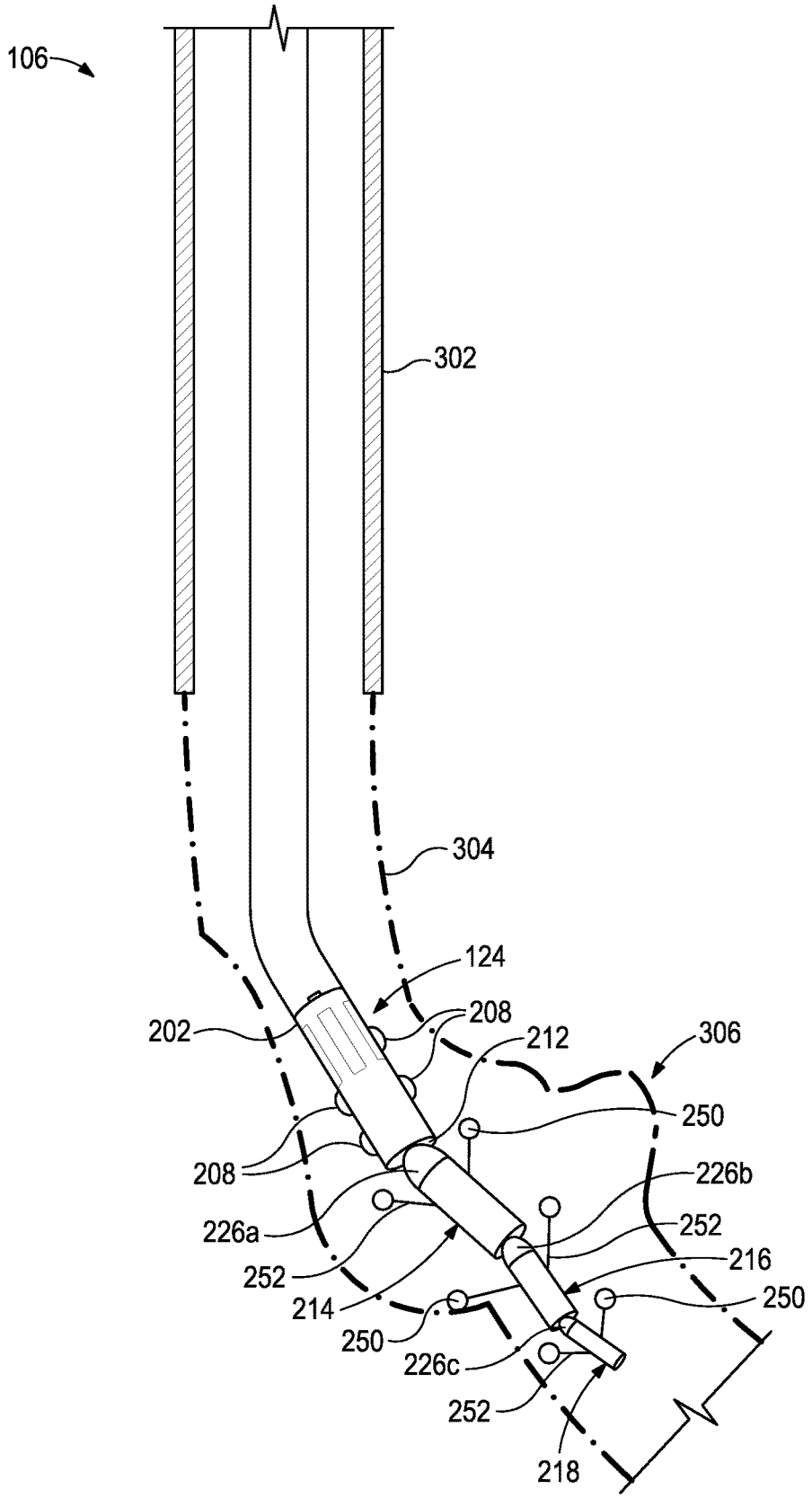

FIGS. 3A-3C are enlarged schematic views of a portion of the wellbore 106 showing example progressive operation of the tool 124, according to one or more embodiments. As illustrated, at least a portion of the wellbore 106 may be lined with casing 302, which may be cemented in place within the wellbore 106 to help prevent borehole collapse. Below the casing 302, the wellbore 106 may include an open hole section 304, which comprises a section of the wellbore 106 not lined with the casing 302 or any other type of wellbore liner.

As illustrated, the open hole section 304 may include a portion of the wellbore 106 that has been washed out, referred to herein as a "washout section 306". The washout section 306 may comprise an enlarged region of the wellbore 106 created as a result of various downhole anomalies. For example, the washout section 306 may be created as a result of hydraulic erosion of the inner wall of the wellbore 106 due to excessive bit jet velocity during drilling. Alternatively, the washout section 306 may be created as a result of collapse of soft or unconsolidated subterranean formations penetrated by the wellbore 106 or in-situ rock stresses in the penetrated formations. In any event, a well operator may be able to use the tool 124 to map out and characterize the shape and size of the washout section 306.

Referring first to FIG. 3A, the tool 124 is shown extended into the wellbore 106 as connected to the coiled tubing 112 and in the nested state. The nested state may alternatively be referred to as the "running mode" for the tool 124. The tool 124 will be in the running mode while lowered into the wellbore 106 on the coiled tubing 112. The tool 124 may remain in the running mode (nested state) until encountering a washout section, such as the washout section 306.

As indicated above, the coiled tubing 112 may not only be configured to convey the tool 124 into the wellbore 106, but may also be able to provide fluids (e.g., hydraulic fluids, treatment fluids, chemicals, etc.) to the tool 124. Moreover, the signal cable 128, if included, may further provide a means of powering the tool 124 and allowing the control system 126 (FIG. 1) to communicate with the tool 124 in real-time. As the tool 124 descends within the wellbore 106, the wheels 208 may help centralize the tool 124 within the wellbore 106 (i.e., the casing 302). Upon encountering the washout section 306, the wheels 208 may also help the tool 124 traverse the washout section 306. As indicated above, for example, the wheels 208 may be powered to advance the tool 124 within the wellbore 106, in either the downhole or uphole directions. Moreover, it is contemplated herein that the wheels 208 may be radially expandable (extendable) outward, to move the wheels 208 into contact (or closer into contact) with adjacent wellbore surfaces. Moreover, the expandable pads 210 arranged about the outer circumference of the main body 202 may be selectively actuated to help change the general trajectory of the tool 124 as it traverses the wellbore 106, including the washout section 306.

In FIG. 3B, the tool 124 is shown transition from the nested state to the deployed state, alternately be referred to as the "washout mapping mode" for the tool 124. The washout mapping mode may be activated when it is determined that the tool 124 cannot progress further downhole within the wellbore 106. This may occur when the tool 124 encounters a downhole obstruction, such as the washout section 306. In at least one embodiments, the well operator operating the tool string at the well surface will trigger operation of the tool 124. In other embodiments, however, the tool 124 may be configured to operate autonomously and trigger operation once its internal sensors and gauges determine that the washout section 306 has been encountered.

In the washout mapping mode, the tool 124 may be configured to commence measuring and mapping the shape and size of the washout section 306. The tool 124 may detect the washout section 306 in a variety of ways. In some embodiments, for example, the tension-compression sensor 240 (FIG. 2B) of the lower joint tool 218 may sense the presence of the washout section 306 upon encountering an obstruction within the wellbore 106. In other embodiments, or in addition thereto, the gyroscope unit 228 (FIG. 2B) of the gyro tool 214 may detect and otherwise sense an anomaly in the wellbore 106 upon encountering the washout section 306.

Once it is determined to transition the tool from the nested state to the deployed state, a signal will be sent to the tool 124 and, more particularly, to the actuation assembly 248 (FIG. 2B) of the main body 202. The actuation assembly 248 may then be operable to extend the subcomponent tools 214-218 out of the inner cavity 212 of the main body 202. The actuation assembly 248 may also be operable to extend the various subcomponent tools 214-218 out of the corresponding host tools, and thus fully transition the tool 124 to the deployed state. Upon transitioning the tool 124 to the deployed state, the arms 252 of each subcomponent tool 214-218 may extend radially outward and thereby correspondingly move the wheels 250 radially outward to potentially engage the inner walls of the washout section 306. As indicated above, in some embodiments the arms 252 may be spring-loaded, but could alternatively be actuatable via hydraulic or mechanical means.

In the deployed state (or the washout mapping mode), the tool 124 may be operable to determine the size and shape of the washout section 306 and thereby map the washout section 306. As indicated above, this can be done using the various tools and sensors included in the subcomponent tools 214-218. For example, the gyroscope unit 228 (FIG. 2B) of the gyro tool 214 may be configured to provide high accuracy space coordination to support mapping of the wellbore 106. Moreover, the sensors 234 (FIG. 2B) included in the azimuth tool 216 may be configured to identify the exact orientation of the tool 124 relative to true north, and thereby help map the general shape of the washout section 306. Furthermore, the camera(s) 242 (FIG. 2B) and the light(s) 244 (FIG. 2B) included in the lower joint tool 218 may be able to provide real-time visual feedback and images of the washout section 306. In addition, if there are any small obstructions preventing movement of the tool 124 further into the wellbore 106, a fluid may be discharged from the lower joint tool 218 via the nozzle(s) 246 (FIG. 2B), as generally described above.

In FIG. 3C, the tool 124 is shown advanced deeper into the wellbore 106, and through the washout section 306. The pivotable couplings 226*a-c* operatively and pivotably coupling the subcomponent tools 214-218 to each other and to the main body 202 allow the subcomponent tools 214-218 to traverse the uneven and unpredictable inner wall surfaces of the washout section 306. Moreover, the wheels 208 on the main body 202 and/or the wheels 250 included on the subcomponent tools 214-218 may passively or actively help the tool 124 traverse the washout section 306.

When it is determined that the tool 124 has successfully traversed the washout section 306 and has entered the remaining or downhole portions of the wellbore 106, the tool 124 may be returned to the nested state (the running mode). To do this, a signal may be sent to the actuation assembly 248 (FIG. 2B) of the main body 202 from the control system 126 (FIG. 1). Transitioning the tool 124 back to the deployed state, requires that the arms 252 and the wheels 250 are first radially retracted back to the stowed configuration in preparation to be received within the host subcomponent tool 214, 216 or the main body 202. Once the arms 252 and the wheels 250 are radially retracted, the actuation assembly 248 may sequentially draw the subcomponent tools 214-218 back into the respective inner cavities 220*a,b* (FIG. 2B) and the central cavity 212 of the main body 202. In at least one embodiment, the actuation assembly 248 may work in conjunction with actuation devices or mechanisms included in the arms 252 and configured to retract the arms 252 back to the stowed configuration. In other embodiments, however, the actuation assembly 248 and the actuation mechanisms of the arms 252 may work independent of one another.

Once the tool 124 is returned to the nested state (running mode), the tool 124 may navigate through to access the remaining portions of the open hole section 304 either for well logging purposes or well treatment operations. Advantageously, the tool 124 provides means of accessing long-reach horizontal wells drilled with washout sections (e.g., the washout section 306), since washout sections often limit well intervention possibilities due to tool orientation.

Figure 4:
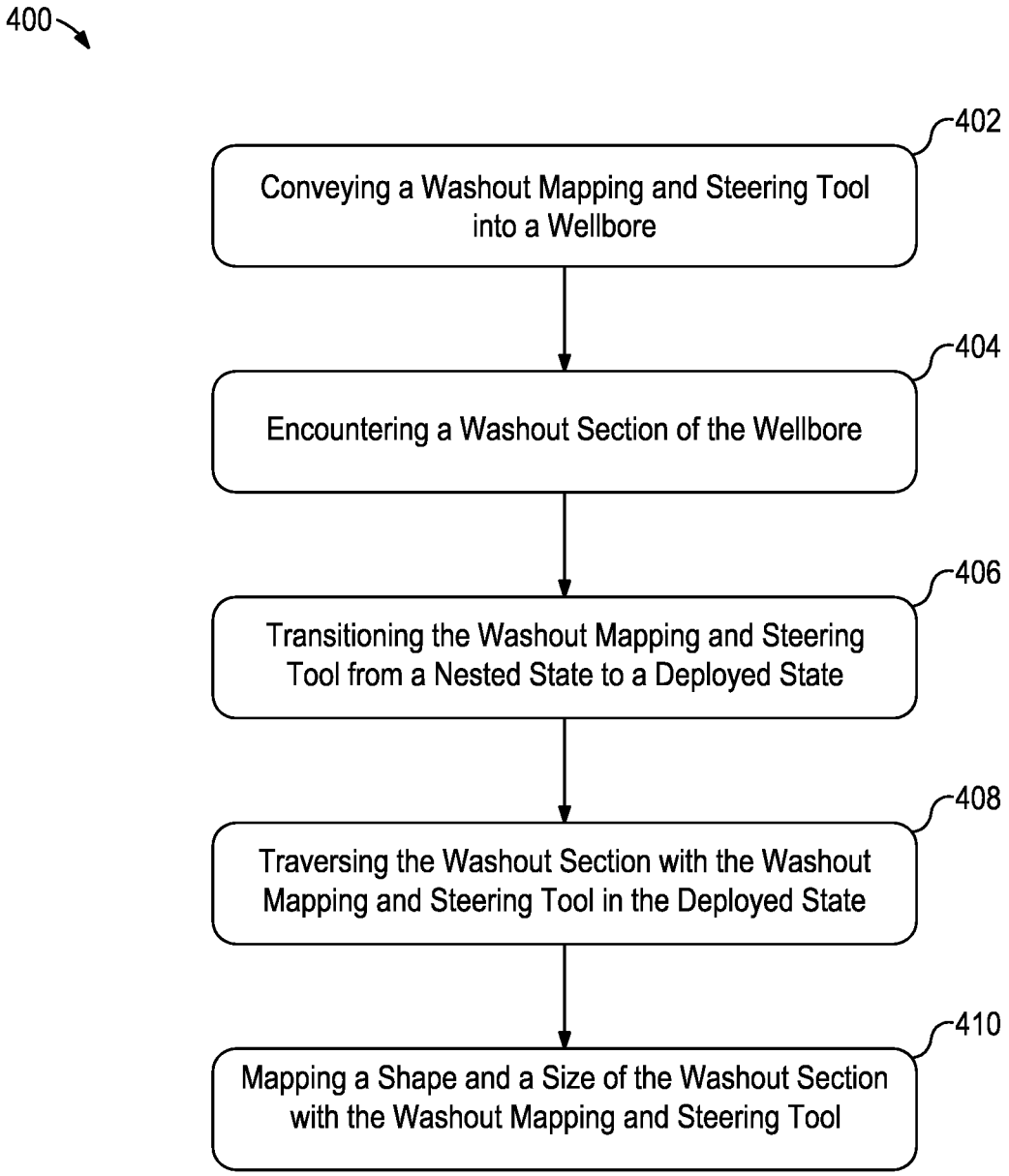
FIG. 4 is a schematic flowchart of an example method of operating the washout mapping and steering tool of FIGS. 2A-2B, according to one or more embodiments.
Figure 5:
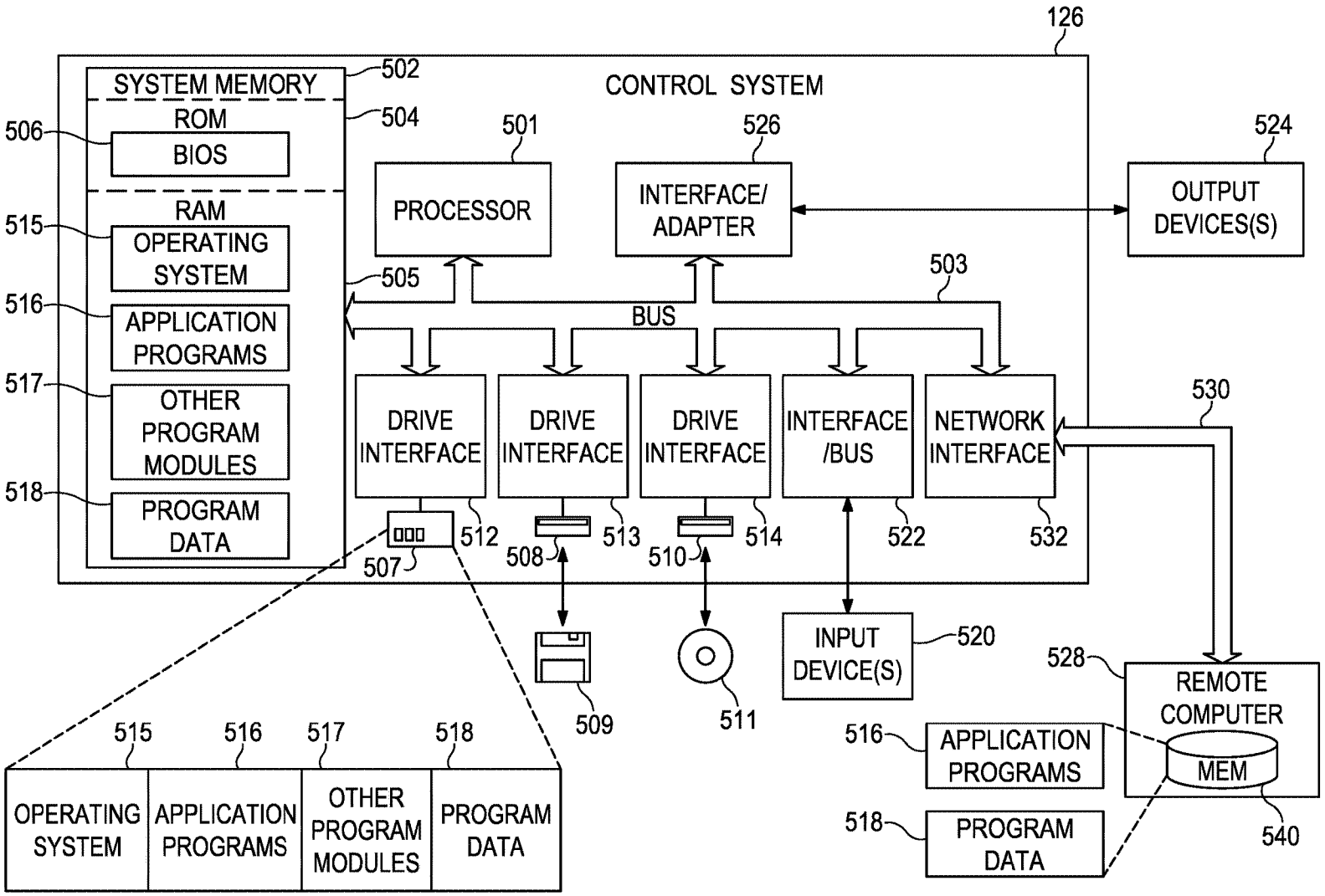
FIG. 5 is a schematic layout of the control system of FIG. 1, according to one or more embodiments.

FIG. 4 is a schematic flowchart of an example method 400 of operating the tool 124, according to one or more embodiments. As illustrated, the method 400 may include conveying a washout mapping and steering tool into a wellbore, as at 402. As described herein, the washout mapping and steering tool can include a main body having opposing first and second ends and defining a central cavity extending at least partially between the first and second ends, and the second end may be open to expose the central cavity. The washout mapping and steering tool can further include one or more subcomponent tools arrangeable within the central cavity in a nested relationship. The one or more subcomponent tools can include a gyro tool, an azimuth tool, and a lower joint tool receivable within the central cavity in a mutually-nested relationship.

The method 400 may further include encountering a washout section of the wellbore, as at 404, and transitioning the washout mapping and steering tool from a nested state to a deployed state, as at 406. In the nested state, the one or more subcomponent tools may be arranged within the central cavity, and in the deployed state the one or more subcomponent tools may be moved out of the central cavity. In some embodiments, the one or more subcomponent tools may include a gyro tool, an azimuth tool, and a lower joint tool receivable within the central cavity in a mutually-nested relationship. In such embodiments, transitioning the washout mapping and steering tool from the nested state to the deployed state, as at 406, may include extending the gyro tool out of the central cavity, extending the azimuth tool out of an inner cavity of the gyro tool, and extending the lower joint tool out of an inner cavity of the azimuth tool.

The method 400 may further include traversing the washout section with the washout mapping and steering tool in the deployed state, as at 408. As described herein, the washout mapping and steering tool may include a plurality of wheels rotatably mounted to the main body and extending radially outward past an outer diameter of the main body, and the plurality of wheels may be configured to engage an inner wall of the washout section to help the washout mapping and steering tool traverse the washout section. Moreover, the washout mapping and steering tool may further include a plurality of expandable pads arranged about an outer circumference of the main body and selectively actuatable to adjusting an orientation of the washout mapping and steering tool within the wellbore. Furthermore, in some embodiments, at least one of the one or more subcomponent tools includes one or more wheels. In such embodiments, traversing the washout section with the washout mapping and steering tool in the deployed state, as at 408, may include extending the one or more wheels radially outward upon moving the washout mapping and steering tool to the deployed state.

The method 400 may further include mapping a shape and a size of the washout section with the washout mapping and steering tool, as at 410. In some embodiments, the washout mapping and steering tool may be operated using a control system arranged at a well surface location. Moreover, once the washout mapping and steering tool has successfully traversed the washout section, the washout mapping and steering tool may be transitioned back to the nested state.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the control system 126 of FIG. 4. Furthermore, portions of the embodiments may be a computer program product on a computer-usable storage medium having computer readable program code on the medium. Any non-transitory, tangible storage media possessing structure may be utilized including, but not limited to, static and dynamic storage devices, hard disks, optical storage devices, and magnetic storage devices, but excludes any medium that is not eligible for patent protection under 35 U.S.C. § 101 (such as a propagating electrical or electromagnetic signal per se). As an example and not by way of limitation, a computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, where appropriate.

Certain embodiments have also been described herein with reference to block illustrations of methods, systems, and computer program products. It will be understood that blocks of the illustrations, and combinations of blocks in the illustrations, can be implemented by computer-executable instructions. These computer-executable instructions may be provided to one or more processor of a general purpose computer, special purpose computer, or other programmable data processing apparatus (or a combination of devices and circuits) to produce a machine, such that the instructions, which execute via the processor, implement the functions specified in the block or blocks.

These computer-executable instructions may also be stored in computer-readable memory that can direct a computer or other programmable data processing apparatus to function in a particular manner, such that the instructions stored in the computer-readable memory result in an article of manufacture including instructions which implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

In this regard, FIG. 4 illustrates one example of the control system 126 that can be employed to execute one or more embodiments of the present disclosure. Control system 126 can be implemented on one or more general purpose networked computer systems, embedded computer systems, routers, switches, server devices, client devices, various intermediate devices/nodes or standalone computer systems. Additionally, control system 126 can be implemented on various mobile clients such as, for example, a personal digital assistant (PDA), laptop computer, pager, and the like, provided it includes sufficient processing capabilities.

Control system 126 includes processing unit 501, system memory 502, and system bus 503 that couples various system components, including the system memory 502, to processing unit 501. Dual microprocessors and other multiprocessor architectures also can be used as processing unit 501. System bus 503 may be any of several types of bus structure including a memory bus or memory controller, a peripheral bus, and a local bus using any of a variety of bus architectures. System memory 502 includes read only memory (ROM) 504 and random access memory (RAM) 505. A basic input/output system (BIOS) 506 can reside in ROM 504 containing the basic routines that help to transfer information among elements within control system 126.

Control system 126 can include a hard disk drive 507, magnetic disk drive 508, e.g., to read from or write to removable disk 509, and an optical disk drive 510, e.g., for reading CD-ROM disk 511 or to read from or write to other optical media. Hard disk drive 507, magnetic disk drive 508, and optical disk drive 510 are connected to system bus 503 by a hard disk drive interface 512, a magnetic disk drive interface 513, and an optical drive interface 514, respectively. The drives and associated computer-readable media provide nonvolatile storage of data, data structures, and computer-executable instructions for control system 126. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 505, including operating system 515, one or more application programs 516, other program modules 517, and program data 518. A user may enter commands and information into control system 126 through one or more input devices 520, such as a pointing device (e.g., a mouse, touch screen), keyboard, microphone, joystick, game pad, scanner, and the like. These and other input devices 520 are often connected to processing unit 502 through a corresponding port interface 522 that is coupled to the system bus, but may be connected by other interfaces, such as a parallel port, serial port, or universal serial bus (USB). One or more output devices 524 (e.g., display, a monitor, printer, projector, or other type of displaying device) is also connected to system bus 503 via interface 526, such as a video adapter.

Control system 126 may operate in a networked environment using logical connections to one or more remote computers, such as remote computer 528. Remote computer 528 may be a workstation, computer system, router, peer device, or other common network node, and typically includes many or all the elements described relative to control system 126. The logical connections, schematically indicated at 530, can include a local area network (LAN) and a wide area network (WAN). When used in a LAN networking environment, control system 126 can be connected to the local network through a network interface or adapter 532. When used in a WAN networking environment, control system 126 can include a modem, or can be connected to a communications server on the LAN. The modem, which may be internal or external, can be connected to system bus 503 via an appropriate port interface. In a networked environment, application programs 516 or program data 518 depicted relative to control system 126, or portions thereof, may be stored in a remote memory storage device 540.

Embodiments disclosed herein include:

A. A well system that includes a coiled tubing system arranged at a well surface and including coiled tubing extendable into a wellbore, and a washout mapping and steering tool conveyable into the wellbore as attached to the coiled tubing, the washout mapping and steering tool including a main body having opposing first and second ends and defining a central cavity extending at least partially between the first and second ends, the first end being operatively coupled to the coiled tubing and the second end being open to expose the central cavity, and one or more subcomponent tools arrangeable within the central cavity in a nested relationship, wherein the washout mapping and steering tool is transitionable within the wellbore between a nested state, where the one or more subcomponent tools are arranged within the central cavity, and a deployed state, where the one or more subcomponent tools are extended out of the central cavity.

B. A method that includes conveying a washout mapping and steering tool into a wellbore, the washout mapping and steering tool including a main body having opposing first and second ends and defining a central cavity extending at least partially between the first and second ends, the second end being open to expose the central cavity, and one or more subcomponent tools arrangeable within the central cavity in a nested relationship. The method may further include encountering a washout section of the wellbore, transitioning the washout mapping and steering tool from a nested state, where the one or more subcomponent tools are arranged within the central cavity, to a deployed state, where the one or more subcomponent tools are moved out of the central cavity, traversing the washout section with the washout mapping and steering tool in the deployed state, and mapping a shape and a size of the washout section with the washout mapping and steering tool as the washout mapping and steering tool traverses the washout section.

C. A washout mapping and steering tool that includes a main body having opposing first and second ends and defining a central cavity extending at least partially between the first and second ends, the second end being open to expose the central cavity, a gyro tool receivable within the central cavity, an azimuth tool receivable within an inner cavity of the gyro tool, and a lower joint tool receivable within an inner cavity of the azimuth tool, wherein the washout mapping and steering tool is transitionable within a wellbore between a nested state, where the gyro tool, the azimuth tool, and the lower joint tool are all arranged within the central cavity in a mutually-nested configuration, and a deployed state, where the gyro tool exits the central cavity, the azimuth tool exits the inner cavity of the gyro tool, and the lower joint tool exits the inner cavity of the azimuth tool.

Each of embodiments A, B, and C may have one or more of the following additional elements in any combination: Element 1: further comprising a control system in communication with the washout mapping and steering tool and configured to control operation of the washout mapping and steering tool. Element 2: further comprising a plurality of expandable pads arranged about an outer circumference of the main body and selectively actuatable to extend radially outward to engage an adjacent inner wall of the wellbore and thereby adjust an orientation of the washout mapping and steering tool within the wellbore. Element 3: wherein the one or more subcomponent tools include a gyro tool, an azimuth tool, and a lower joint tool all receivable within the central cavity in a mutually-nested relationship. Element 4: wherein the gyro tool is receivable within the central cavity, the azimuth tool is receivable within an inner cavity of the gyro tool, and the lower joint tool is receivable within an inner cavity of the azimuth tool, and wherein, when the washout mapping and steering tool is transitioned to the deployed state, the gyro tool exits the central cavity, the azimuth tool exits the inner cavity of the gyro tool, and the lower joint tool exits the inner cavity of the azimuth tool. Element 5: wherein the lower joint tool includes one or more of a tension-compression sensor operable to monitor for downhole obstructions within the wellbore, one or more cameras that provide real-time visual feedback and images of an interior of the wellbore, one or more lights that illuminate the interior the wellbore, and one or more nozzles operable to discharge a fluid into the wellbore to help clear obstructions within the wellbore. Element 6: wherein at least one of the one or more subcomponent tools includes one or more wheels operable to extend radially outward upon moving to the deployed state. Element 7: wherein the one or more wheels are rotatably mounted to a corresponding one or more radially extendible arms operable to transition the one or more wheels between stowed and extended configurations.

Element 8: further comprising operating the washout mapping and steering tool with a control system arranged at a well surface location. Element 9: further comprising engaging an inner wall of the washout section with a plurality of wheels rotatably mounted to the main body and extending radially outward past an outer diameter of the main body. Element 10: further comprising selectively actuating a plurality of expandable pads arranged about an outer circumference of the main body and thereby adjusting an orientation of the washout mapping and steering tool within the wellbore. Element 11: wherein the one or more subcomponent tools include a gyro tool, an azimuth tool, and a lower joint tool receivable within the central cavity in a mutually-nested relationship, and wherein transitioning the washout mapping and steering tool from the nested state to the deployed state comprises extending the gyro tool out of the central cavity, extending the azimuth tool out of an inner cavity of the gyro tool, and extending the lower joint tool out of an inner cavity of the azimuth tool. Element 12: further comprising determining the shape and the size of the washout section with the gyro tool, identifying an orientation of the washout mapping and steering tool relative to true north with the azimuth tool, and monitoring for downhole obstructions within the wellbore with the lower joint tool. Element 13: further comprising obtaining real-time visual feedback and images of an interior of the wellbore with one or more cameras included in the lower joint tool, and illuminating the interior the wellbore with one or more lights included in the lower joint tool. Element 14: further comprising discharging a fluid into the wellbore from one or more nozzles included in the lower joint tool and thereby clearing obstructions within the wellbore. Element 15: wherein at least one of the one or more subcomponent tools includes one or more wheels, the method further comprising extending the one or more wheels radially outward upon moving the washout mapping and steering tool to the deployed state. Element 16: further comprising transitioning the washout mapping and steering tool back to the nested state upon traversing the washout section.

Element 17: further comprising a plurality of wheels rotatably mounted to the main body and extending radially outward past an outer diameter of the main body. Element 18: further comprising a plurality of expandable pads arranged about an outer circumference of the main body and selectively actuatable to extend radially outward to engage an adjacent inner wall of a wellbore and thereby adjust an orientation of the washout mapping and steering tool within the wellbore. Element 19: wherein the gyro tool is pivotably coupled to the main body at a first pivotable coupling, the azimuth tool is pivotably coupled to the gyro tool at a second pivotable coupling, and the lower joint tool is pivotably coupled to the azimuth tool at a third pivotable coupling. Element 20: wherein the lower joint tool includes one or more of a tension-compression sensor operable to monitor for downhole obstructions within the wellbore, one or more cameras that provide real-time visual feedback and images of an interior of the wellbore, one or more lights that illuminate the interior the wellbore, and one or more nozzles operable to discharge a fluid into the wellbore to help clear obstructions within the wellbore. Element 21: wherein at least one of the gyro tool, the azimuth tool, and the lower joint tool includes one or more wheels operable to extend radially outward upon moving to the deployed state. Element 22: wherein the one or more wheels are rotatably mounted to a corresponding one or more radially extendible arms operable to transition the one or more wheels between stowed and extended configurations.

By way of non-limiting example, exemplary combinations applicable to A, B, and C include: Element 3 with Element 4; Element 3 with Element 5; Element 6 with Element 7; Element 11 with Element 12; Element 12 with Element 13; Element 12 with Element 14; and Element 21 with Element 22.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a washout mapping and steering tool conveyable into a wellbore by coiled tubing, the washout mapping and steering tool including:

a main body having opposing first and second ends and defining a central cavity extending at least partially between the first and second ends, the first end being operatively couplable to the coiled tubing and the second end being open to expose the central cavity; and a gyro tool, an azimuth tool, and a lower joint tool all being arrangeable within the central cavity in a mutually-nested relationship, wherein at least one of the gyro tool, the azimuth tool, and the lower joint tool is axially movable relative to the main body and pivotably coupled to the main body, wherein the washout mapping and steering tool is transitionable within the wellbore between a nested state, where the gyro tool, the azimuth tool, and the lower joint tool are arranged within the central cavity, and a deployed state, where the gyro tool, the azimuth tool, and the lower joint tool are extended out of the central cavity.

2. The well system of claim 1, further comprising a control system in communication with the washout mapping and steering tool and configured to control operation of the washout mapping and steering tool.

3. The well system of claim 1, further comprising a plurality of expandable pads arranged about an outer circumference of the main body and selectively actuatable to extend radially outward to engage an adjacent inner wall of the wellbore and thereby adjust an orientation of the washout mapping and steering tool within the wellbore.

4. The well system of claim 1, wherein the gyro tool is receivable within the central cavity, the azimuth tool is receivable within an inner cavity of the gyro tool, and the lower joint tool is receivable within an inner cavity of the azimuth tool, and wherein, when the washout mapping and steering tool is transitioned to the deployed state, the gyro tool exits the central cavity, the azimuth tool exits the inner cavity of the gyro tool, and the lower joint tool exits the inner cavity of the azimuth tool.

5. The well system of claim 1, wherein the lower joint tool includes one or more of:

a tension-compression sensor operable to monitor for downhole obstructions within the wellbore;

one or more cameras that provide real-time visual feedback and images of an interior of the wellbore;

one or more lights that illuminate the interior the wellbore; and one or more nozzles operable to discharge a fluid into the wellbore to help clear obstructions within the wellbore.

6. The well system of claim 1, wherein at least one of the gyro tool, the azimuth tool, and the lower joint tool includes one or more wheels operable to extend radially outward upon moving to the deployed state.

7. The well system of claim 6, wherein the one or more wheels are rotatably mounted to a corresponding one or more radially extendible arms operable to transition the one or more wheels between stowed and extended configurations.

8. The well system of claim 1, wherein the gyro tool, the azimuth tool, and the lower joint tool each include a plurality of arms that are in a retracted position in the nested state that are moveable to an extended position when in the deployed state.

9. A method, comprising:

conveying a washout mapping and steering tool into a wellbore, the washout mapping and steering tool including:

a main body having opposing first and second ends and defining a central cavity extending at least partially between the first and second ends, the second end being open to expose the central cavity; and one or more subcomponent tools arrangeable within the central cavity in a nested relationship, the one or more subcomponent tools comprising:

a first subcomponent tool receivable in the central cavity and axially movable relative to the main body and pivotably coupled to the main body, the first subcomponent tool including a first inner cavity; and a second subcomponent tool receivable in the first inner cavity and axially moveable relative to the first subcomponent tool and pivotably coupled to the first subcomponent tool, the second subcomponent tool including a second inner cavity; and a third subcomponent tool receivable in the second inner cavity and axially moveable relative to the second subcomponent tool and pivotably coupled to the second subcomponent tool;

encountering a washout section of the wellbore;

transitioning the washout mapping and steering tool from a nested state to a deployed state, wherein:

in the nested state, the one or more subcomponent tools are arranged within the central cavity, the second subcomponent tool is disposed within the first inner cavity, and the third subcomponent tool is disposed within the second inner cavity, and in the deployed state, the one or more subcomponent tools are moved out of the central cavity, the second subcomponent tool is extended out of the first inner cavity, and the third subcomponent tool is extended out of the second inner cavity; and traversing the washout section with the washout mapping and steering tool in the deployed state.

10. The method of claim 9, further comprising engaging an inner wall of the washout section with a plurality of wheels rotatably mounted to the main body and extending radially outward past an outer diameter of the main body.

11. The method of claim 9, further comprising selectively actuating a plurality of expandable pads arranged about an outer circumference of the main body and thereby adjusting an orientation of the washout mapping and steering tool within the wellbore.

12. The method of claim 9, wherein the first subcomponent tool is a gyro tool, the second subcomponent tool is an azimuth tool, and the third subcomponent tool is a lower joint tool.

13. The method of claim 12, further comprising one or more of:

determining the shape and the size of the washout section with the gyro tool;

identifying an orientation of the washout mapping and steering tool relative to true north with the azimuth tool; and monitoring for downhole obstructions within the wellbore with the lower joint tool.

14. The method of claim 13, further comprising one or more of:

obtaining real-time visual feedback and images of an interior of the wellbore with one or more cameras included in the lower joint tool; and illuminating the interior the wellbore with one or more lights included in the lower joint tool.

15. The method of claim 13, further comprising discharging a fluid into the wellbore from one or more nozzles included in the lower joint tool and thereby clearing obstructions within the wellbore.

16. The method of claim 9, wherein at least one of the one or more subcomponent tools includes one or more wheels, the method further comprising extending the one or more wheels radially outward upon moving the washout mapping and steering tool to the deployed state.

17. The method of claim 9, wherein the first subcomponent tool, the second subcomponent tool, and the third subcomponent tool each include a plurality of arms that are in a retracted position in the nested state that are moveable to an extended position when in the deployed state.

18. A washout mapping and steering tool, comprising:

a main body having opposing first and second ends and defining a central cavity extending at least partially between the first and second ends, the second end being open to expose the central cavity;

a first tool receivable within the central cavity and including first arms moveable between a retracted position and an extended position; and a second tool receivable within an inner cavity of the first tool and including second arms moveable between a retracted position and an extended position;

wherein the washout mapping and steering tool is transitionable within a wellbore between a nested state, where the first tool and the second tool are arranged within the central cavity in a mutually-nested configuration with the first and second arms being in the retracted position, and a deployed state, where the first tool exits the central cavity and the second tool exits the inner cavity of the first tool, and wherein the first and second arms are moveable to the extended position in the deployed state.

19. The washout mapping and steering tool of claim 18, further comprising a plurality of wheels rotatably mounted to the main body and extending radially outward past an outer diameter of the main body.

20. The washout mapping and steering tool of claim 18, further comprising a plurality of expandable pads arranged about an outer circumference of the main body and selectively actuatable to extend radially outward to engage an adjacent inner wall of a wellbore and thereby adjust an orientation of the washout mapping and steering tool within the wellbore.

21. The washout mapping and steering tool of claim 18, wherein the first tool is pivotably coupled to the main body at a first pivotable coupling, and the second tool is pivotably coupled to the first tool at a second pivotable coupling.

22. The washout mapping and steering tool of claim 18, further comprising a third tool receivable within an inner cavity of the second tool, wherein the third tool includes one or more of:

a tension-compression sensor operable to monitor for downhole obstructions within the wellbore;

one or more cameras that provide real-time visual feedback and images of an interior of the wellbore;

one or more lights that illuminate the interior the wellbore; and one or more nozzles operable to discharge a fluid into the wellbore to help clear obstructions within the wellbore.

23. The washout mapping and steering tool of claim 18, wherein the first and second arms include wheels at an end thereof.

24. The washout mapping and steering tool of claim 18, wherein the first tool comprises a gyro tool and the second tool comprises an azimuth tool.

25. The washout mapping and steering tool of claim 24, further comprising a lower joint tool receivable within an inner cavity of the azimuth tool, wherein:

in the nested state, the gyro tool, the azimuth tool, and the lower joint tool are all arranged within the central cavity in the nested state; and in the deployed state, the gyro tool exits the central cavity, the azimuth tool exits the inner cavity of the gyro tool, and the lower joint tool exits the inner cavity of the azimuth tool.

* * * * *